US006470917B2

(12) United States Patent
Yamamoto

(10) Patent No.: US 6,470,917 B2
(45) Date of Patent: Oct. 29, 2002

(54) TACK-IN APPARATUS

(75) Inventor: Akihiko Yamamoto, Mattou (JP)

(73) Assignee: Tsudakoma Kogyo Kabushiki Kaisha, Kanazawa (JP)

( * ) Notice: Subject to any disclaimer, the term of this patent is extended or adjusted under 35 U.S.C. 154(b) by 0 days.

(21) Appl. No.: 09/915,849

(22) Filed: Jul. 26, 2001

(65) Prior Publication Data

US 2002/0020457 A1 Feb. 21, 2002

(30) Foreign Application Priority Data

Aug. 10, 2000 (JP) ..... 2000-242416

(51) Int. Cl.[7] ..... D03D 47/48
(52) U.S. Cl. ..... 139/434; 139/194; 139/435.4
(58) Field of Search ..... 139/434, 194, 139/435.4

(56) References Cited

U.S. PATENT DOCUMENTS 4,691,745 A * 9/1987 Takekawa et al. ..... 139/435
6,240,976 B1 * 6/2001 Satoh et al. ..... 139/434

FOREIGN PATENT DOCUMENTS

JP 2001-49550 A 2/2001

* cited by examiner

*Primary Examiner*—Danny Worrell
*Assistant Examiner*—Robert Muromoto, Jr.
(74) *Attorney, Agent, or Firm*—Frishauf, Holtz, Goodman & Chick, P.C.

(57) ABSTRACT

A tack-in apparatus is provided wherein injection ports are arranged at upper and lower sides of a weft yarn path, respectively. The injection ports inject currents for folding back an end portion of a cut weft yarn into a warp yarn opening on the weft yarn path which the weft yarn passes by a beating operation. Air guides projecting toward the warp yarn opening are formed at circumferential portions of the injection ports between the weft yarn path and the injection ports. The surfaces of the air guides which are on the sides of the injection ports are inclined toward the weft yarn path at front end portions of the air guides. In order to tack in the weft yarn end, the injection air currents are directed to the central portion of the warp yarn opening. This enables the weft yarn end to be transferred reliably, the tack-in operation to be carried out reliably, and the turbulence of the warp yarn to be reduced.

5 Claims, 4 Drawing Sheets

TACK-IN APPARATUS

BACKGROUND OF THE INVENTION

1. Field of the Invention

The present invention relates to a tack-in apparatus adapted to draw an end portion of weft yarn into a warp yarn opening with an injection air current.

2. Description of the Related Art

There is a related art tack-in apparatus provided on both sides of a woven fabric on a shuttleless loom, and adapted to temporarily retain after weft insertion and beating are carried out an end of weft yarn cut to a required weft insertion length and thereafter tack this weft yarn end in a warp yarn opening with an injection air current. In addition, in the tack-in apparatus in the shuttleless loom disclosed, for example, in Japanese Patent Laid-Open No. 49550/2001 of the applicant of the invention, a weft yarn end gripping unit for temporarily retaining a weft yarn end, and tack-in nozzles for blowing the weft yarn end to the side of a cloth fell with an injection air current and thereby tack in the same are formed in a single nozzle block.

Injection ports of the tack-in nozzles are opened in the side surface of the nozzle block which is opposed to a warp yarn array, and two tack-in nozzles are provided on the discharge side of the cloth fell and on both the upper and lower sides of a position of the height of a warp line which constitutes a weft yarn path when a beating operation is carried out. The tack-in nozzles are communicated on the inner side of the nozzle block with an air passage, which is joined to a regulator and a pressure air source via change-over valves. The opening and closing of each change-over valve is controlled automatically by a control circuit.

In the case of this related art apparatus, the warp yarn in the vicinity of an end portion of the woven fabric is disordered by the injection air diffused from the tack-in nozzles during a tack-in operation, and a space formed between upper and lower warp yarn when the warp yarn is opened varies. Consequently, a weft inserting operation was carried out unstably. There was the possibility that the injection air impinged forcibly upon the warp yarn to cause the same to be broken, and that an uneven woven fabric in which the condition of the portion thereof which was in the vicinity of a selvage thereof and that of a central portion thereof were different was formed. Especially, in a pile fabric, which is greatly influenced by an air injection current due to a low tensile force of pile warp yarn, uneven formation of pile and breakage of pile warp yarn occur. This caused the quality of the fabric to lower.

In order to improve the convergence of the air injection current, upper and lower tack-in nozzels have been inclined toward a warp line, and the axes of the tack-in nozzels have been crossed. However, when the tack-in nozzels are inclined greatly, a speed component toward a warp yarn opening decreases to cause a weft yarn and transfer force during a tack-in operation to lower and the injection air currents to interfere with each other greatly. Consequently, a turblent flow occured to cause the weft yarn transfer force to be lowered.

The invention has been made in view of the above-mentioned circumstances, and provides a tack-in apparatus capable of directing injection air currents toward a central portion of a warp yarn opening at the time for carrying out the tacking-in of a weft yarn end; transferring the weft yarn end reliably and carrying out a tack-in operation; and reducing the turbulence of the warp yarn.

SUMMARY OF THE INVENTION

The invention relates to a tack-in apparatus provided with a cutter for cutting weft yarn after the weft insertion is carried out, and tack-in nozzles for folding back an end portion of the weft yarn cut with the cutter into a warp yarn opening with injection air currents, injection ports of the tack-in nozzles being opened in at least one of upper and lower sides of a path which the weft yarn passes by a beating operation, in which apparatus air guides projecting toward the warp yarn opening are formed between the parts of the weft yarn path which are in the vicinity of circumferential portions of the injection ports and the same injection ports. The surfaces of the air guides which are on the sides of the injection ports are inclined toward the weft yarn path as the surfaces extend closer to front ends of the guides.

The injection ports in the invention are formed in a nozzle block provided adjacently to a warp yarn side portion of the cutter. This nozzle block is provided with a slit which is opened in three directions, i.e., toward the warp yarn side, discharge side and cutter side, and which extends along the weft yarn path, and a weft yarn end releasing nozzle opened at an injection port thereof into the slit and blowing the weft yarn end in the slit toward the discharge side of the slit via injection air. Not less than one injection port of the tack-in nozzles is opened in the portions of the warp yarn side surface of the nozzle block which are above and below respectively of the slit, and the portion of the nozzle block which is between the injection port of at least one of the tack-in nozzles and the slit is provided with the air guide.

The tack-in apparatus according to the invention is adapted to bend the air injection currents from the air injection ports toward the weft yarn path owing to a Coanda effect and by the air guides provided on the weft yarn path sides of the air injection ports, increase the air currents flowing toward a central portion of the warp yarn opening, and transfer the end portion of the weft yarn efficiently. Further, it serves to minimize the air injection currents impinging upon the warp yarn to reduce the turbulence of the warp yarn.

DESCRIPTION OF THE PREFERRED EMBODIMENTS

Figure 1:
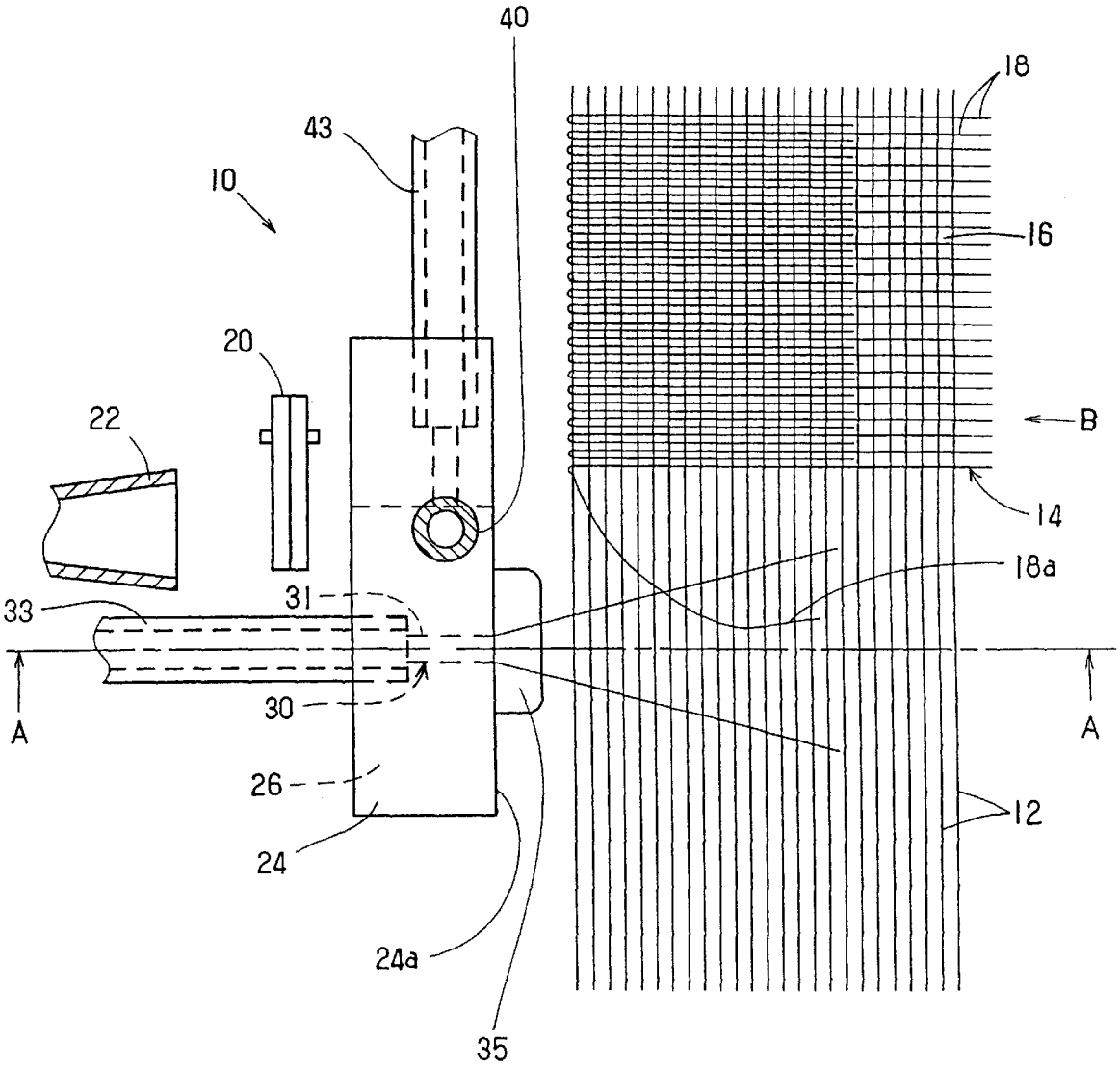
FIG. 1 is a plan view of a first mode of embodiment of the tack-in apparatus according to the invention.
Figure 2:
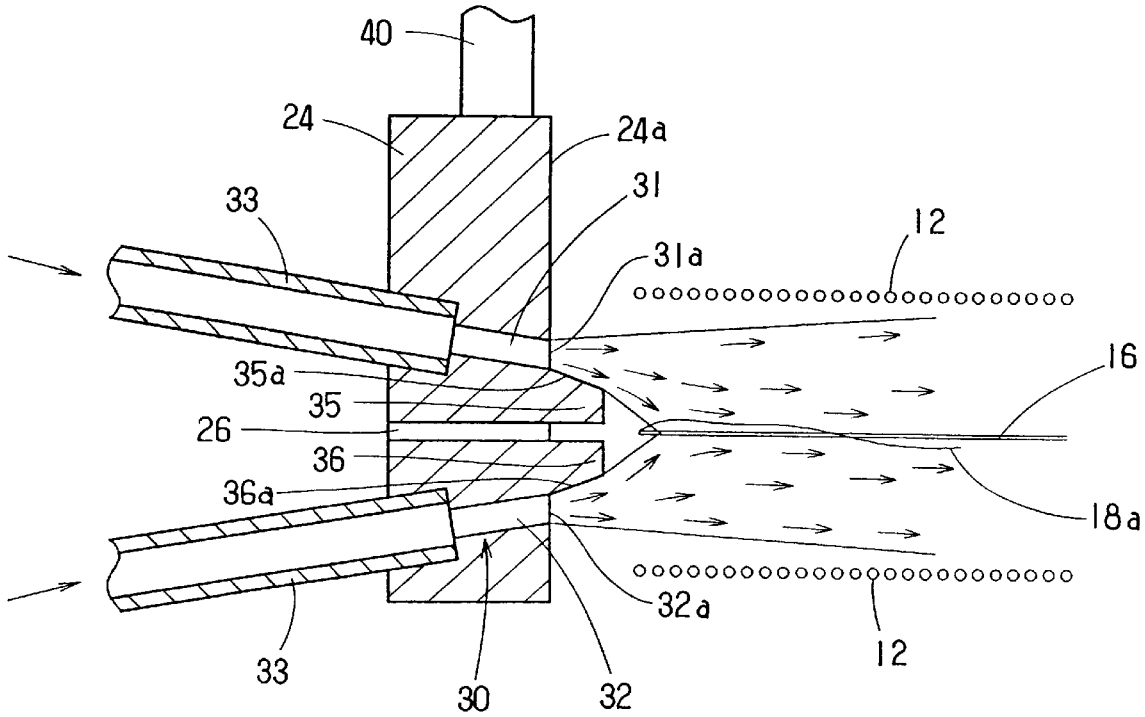
FIG. 2 is a sectional view taken along the line A—A in FIG. 1.
Figure 3:
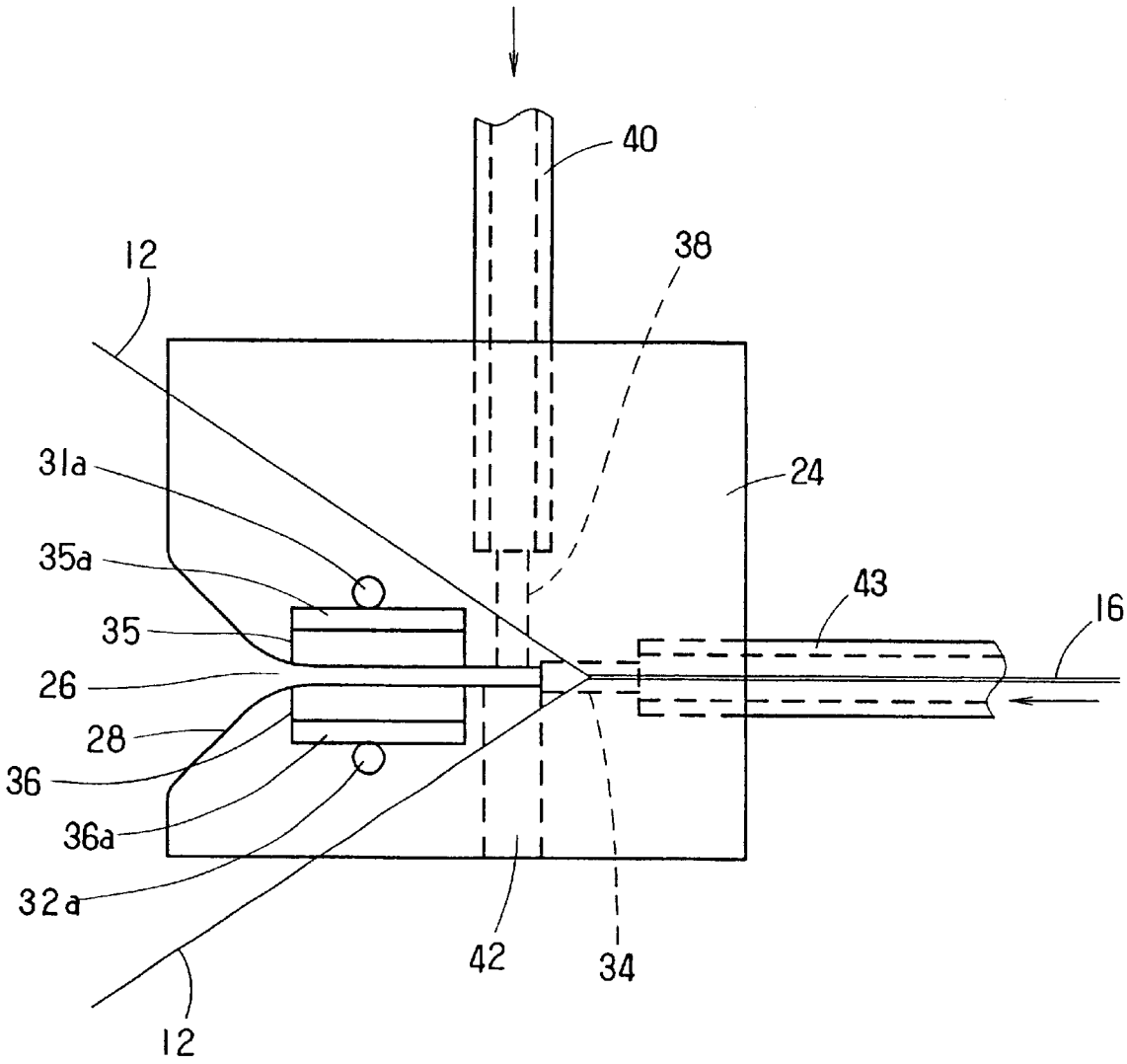
FIG. 3 is a right side view of the apparatus of FIG. 1.

The modes of embodiment of the invention will now be described on the basis of the drawings. FIG. 1 to FIG. 3 show a mode of embodiment of a tack-in apparatus 10 according to the invention. A pair of tack-in apparatuses 10 are provided symmetrically on both sides of a cloth fell 14 of a woven fabric 16 in which an opening of warp yarn 12 being woven is formed. Out of the two tack-in apparatuses 10, one tack-in apparatus is provided with a weft inserting main nozzle (not shown) on the anti-woven-fabric side thereof, and the other tack-in apparatus a suction nozzle 22 for sucking and retaining a front end of inserted weft yarn on the anti-woven-fabric side thereof. A weft yarn cutter 20 is provided between the tack-in apparatus 10 and suction nozzle 22 or weft yarn inserting main nozzle. Since the basic construction of the two tack-in apparatuses 10 is symmetric, the construction of the tack-in apparatus 10 on the side of the suction nozzle 22 will be described as a typical construction thereof in this mode of embodiment.

The tack-in apparatus 10 is provided in the vicinity of a cloth fell 14 with a substantially rectangular nozzle block 24 one side surface of which is opposed to rows of warp yarn 12 in parallel therewith. The nozzle block 24 is provided with as lit 26 as a weft yarn end guide groove opened in three directions, i.e., at the side of a reed and weft yarn which are at the discharge side, and at the side of the cutter, the slit being formed so as to extend to a position near the cloth fell 14. The upper and lower edges of a reed-side end portion of the weft yarn end guide groove 26 are provided with vertically diverging guide surfaces 28 so that a weft yarn end 18a is introduced reliably into the weft yarn end guide groove 26.

The nozzle block 24 is provided with a pair of tack-in nozzles 30 formed of a first nozzle 31 positioned above the slit 26 and a second nozzle 32 positioned below the slit 26. Injection ports 31*a,* 32*a* of the first nozzle 31 and second nozzle 32 are opened in the side surface 24*a* of the nozzle block 24 which is on the side of the warp yarn 12, and these injection ports are opposed to a warp yarn opening. The axis of an air injection current from the first nozzle 31 is set so that the axis extends from a position diagonally above a plane, which extends from a surface of a woven fabric 16, so as to cross the center of warp yarn opening, while the axis of an air injection current from the second nozzle 32 is set so that the axis extends from a position diagonally below the plane, which extends from the surface of the woven fabric 16, so as to cross the center of the warp yarn opening.

The first nozzle 31 and second nozzle 32 of the tack-in nozzles 30 are connected to a pair of air supply pipes 33 respectively, and each air supply pipe 33 to a pressure air source provided with a regulator (not shown) and the like via an electromagnetically driven type change-over valve.

A projection-like air guide 35 adjacent to a lower side of a circumferential portion of the injection port 31*a* of the first nozzle 31 and projecting toward the warp yarn 18 is formed between the injection port 31 in the side surface 24*a* of the nozzle block 24 and slit 26. The air guide 35 is formed by extending the nozzle block 24 from the portion thereof which is above the slit 26. An inclined surface 35*a* of the air guide 35 contacts a lower side of the circumferential portion of the injection port 31*a,* and extends diagonally so as to approach the weft yarn path as the inclined surface comes closer to a free end of the air guide 35. A projection-like air guide 36 extending toward the warp yarn 18 is also provided similarly on an upper side of a circumferential portion of the injection port 32*a* of and adjacently to the second nozzle 32. An inclined surface 36*a* of the air guide 36 also extends diagonally so as to approach the weft yarn path as the inclined surface comes closer to a free end of the air guide 36.

As shown in FIG. 3, an injection port of a weft yarn end releasing nozzle 34 is opened in a rear wall portion of the slit 26 of the nozzle block 24. The axis of an air injection current from the weft yarn end releasing nozzle 34 is set so as to extend toward a discharge side. The weft yarn end releasing nozzle 34 is connected to an air supply pipe 43, and an air supply pipe pressure air source provided with a regulator and the like, via an electromagnetically driven type change-over valve.

An injection port of a weft yarn gripping nozzle 38 is opened in an upper surface out of a pair of mutually opposed inner surfaces of the slit 26 of the nozzle block 24. A weft yarn end gripping bore 42, a through bore formed so as to be opposed to the weft yarn end gripping nozzle 38 and extending perpendicularly to the outer side of the nozzle block 24 is provided in a lower surface of the slit 26. The axis of an air injection current from the weft yarn end gripping nozzle 38 is set so that the axis extends to an inner side of the weft yarn end gripping bore 42. The weft yarn gripping nozzle 38 is connected to an air supply pipe 40, which is connected to a pressure air source including a regulator and the like, via an electromagnetically driven type change-over valve. Each change-over valve is connected to a control unit adapted to electromagnetically drive the valve in accordance with a predetermined program.

The operation of this tack-in apparatus 10 will now be described. First, after the weft yarn is inserted, the opening of the warp yarn 12 is closed and then opened in an opposite phase, and an end portion of the weft yarn 18 enters the slit 26 of the nozzle block 24 owing to a forward movement of a reed (not shown). During this time, a front end portion of the weft yarn 18 is caught by the suction nozzle 22. The weft yarn 18 is then cut with the cutter 20 at a point in time at which the reed moves back slightly after a beating operation is carried out. At this weft yarn cutting time, the weft yarn end gripping nozzle 38 is opened, and an air current is injected from the same nozzle 38 toward the weft yarn gripping bore 42. The end 18*a* of the cut weft yarn is drawn by the air current from the weft yarn end gripping nozzle 38, and moored in the weft yarn end gripping bore 42, the weft yarn end 18*a* being gripped in advance of a tack-in operation.

When the reed further moves back, the subsequent weft insertion is carried out with predetermined timing. The weft yarn end releasing nozzle 34 and tack-in nozzles 30 are opened with predetermined timing respectively, and the weft yarn end gripping nozzle 38 is closed. As a result, the air current from the weft yarn end gripping nozzle 38 decreases gradually, and stops finally, while the air injection currents from the weft yarn end releasing nozzle 34 and tack-in nozzles 30 increase gradually, and attain predetermined flow rates at predetermined time respectively. Therefore, the holding power of the weft yarn end gripping nozzle 38 decreases gradually, and the weft yarn end 18*a* is blown from an end portion of the woven fabric 16 toward the discharge side by the air injection current from the weft yarn end releasing nozzle 38, and placed in a stretched state in an injection current working zone of the tack-in nozzles 30. The front weft yarn end 18*a* in this condition is then blown by the air injection current from the tack-in nozzles 30 into the opening of the warp yarn 12 and tacked in. The opened state of the tack-in nozzles 30 continues until an instant in the vicinity of that of the completion of the weft inserting operation, and the nozzles are thereafter closed. Even after the closing of the tack-in nozzles, the residual air continues to be injected from the tack-in nozzles 30 for a predetermined period of time as the injection rate decreases gradually. Accordingly, the weft yarn end 18*a* kept in a tacked-in state is bound to the closed warp yarn 12 with the inserted weft yarn 18 owing to the closing of the weft yarn opening, and then beaten up, so that a tacked-in selvage is formed on an end portion of the woven fabric 16.

According to the tack-in apparatus 10 of this mode of embodiment, the air guides 35, 36 adjacent to the injection ports 31*a,* 32*a* are formed between the injection ports 31*a,* 32*a,* which are in the side surface 24*a* of the nozzle block 24, of the tack-in nozzles 30 and slit 26 which constitutes a weft yarn path. Therefore, the air currents injected from the injection ports 31*a,* 32*a* are bent toward the weft yarn path owing to the Coanda effect, and the air current flowing toward the central portion of the opening of the warp yarn 12 increases. This enables the weft yarn end 18*a* to be blown forcibly into the warp yarn opening with a high efficiency and put in a stretched state, and a firm and excellent tacked-in selvage to be formed. The quality of the woven fabric can be kept excellent with the occurrence of air injection current which impinges upon the warp yarn minimized and without causing the turbulence of the warp yarn 12 and the breakage thereof to occur. Especially, during the formation of a pile woven fabric, a difference between the condition of formation of pile in a central portion of the woven fabric and that of formation of pile in the portion thereof which is in the vicinity of a selvage does not occur, so that a uniform and high-quality woven fabric is obtained.

The upper and lower air currents injected from the injection ports 31*a,* 32*a* meet each other after they are bent and flow toward the air guides. Therefore, when these air injection currents meet each other, they cushion the shock, which occurs at this time, with respect to each other. Consequently, the occurrence of a turbulent flow is prevented, and the convergence of the injection air currents becomes high. Therefore, it becomes possible to minimize the cross for improving the convergence of injection currents of the axes of the tack-in nozzles, reduce a turbulent flow occurring when the injection air currents meet each other, and prevent the diffusion of the air currents, which is ascribed to a turbulent flow thereof, and a decrease in the velocity of flow of the air currents. This also serves to minimize the air currents impinging upon the warp yarn 12.

Figure 4:
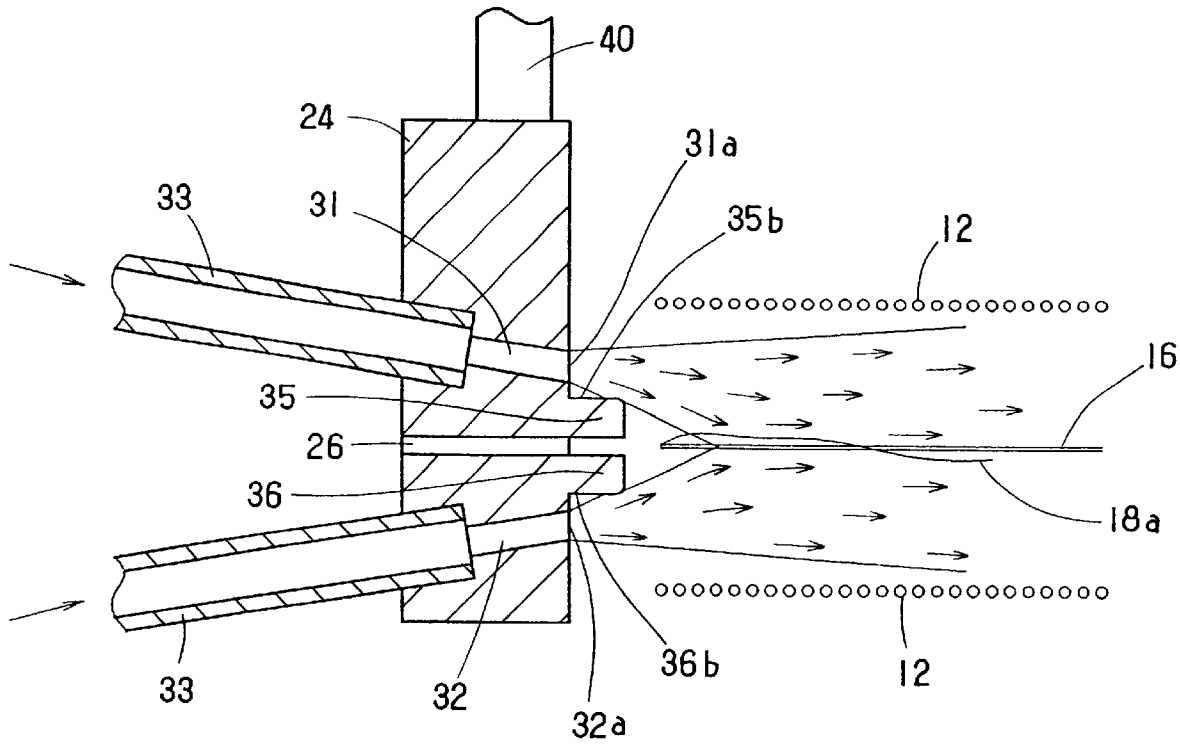
FIG. 4 is a sectional view of another mode of embodiment of the tack-in apparatus according to the invention.

In the tack-in apparatus 10 of this mode of embodiment, the side surfaces 35*b,* 36*b* of the air guides 35, 36 may also be formed as shown in FIG. 4, in such a manner that each of these side surfaces is spaced slightly from the injection ports 31*a,* 32*a,* and formed at right angles to the side surface 24*a* of the nozzle block 24. The number of the injection ports of the tack-in nozzles is not limited to two, i.e., one each on the upper and lower side positions. These injection ports may be provided in either one of the upper and lower positions, or not less than two pairs of injection ports may also be provided.

In the tack-in apparatus according to the invention, the injection air currents from the tack-in nozzles are bent toward the air guides owing to a Coanda effect thereof, concentrated on the weft yarn path and flow toward the weft yarn opening. Therefore, the injection air currents efficiently transfer the weft yarn end into the warp yarn opening, and can be tacked in reliably. Moreover, the diffusion of the injection air currents can be suppressed, and the turbulence of the warp yarn due to the air currents can be reduced. Especially, since the air guides are formed so as to have inclined surfaces at the sides thereof which are near the injection ports, the injection air currents can be bent toward the weft yarn path, so that the convergence of the injection air currents can be improved.

When the injection ports of the tack-in nozzles are opened in the portions of a nozzle block having a slit along the weft yarn path which are above and below the slits, the weft yarn end can be held reliably owing to the slit until the tack-in time, and released reliably by a weft yarn releasing nozzle at the tack-in time. The injection air currents from the upper and lower tack-in nozzles are bent toward the air guides owing to a Coanda effect, and the air currents flowing toward the central portion of the warp yarn opening increase and become strong. Since, during this time, the upper and lower air injection currents meet each other after they flow along the air guides, the occurrence of the interference of the air currents with each other and a change of the air currents into a turbulent flow can be prevented when the air currents meet each other, so that the diffusion of the air currents and a decrease in the velocity of flow thereof which are ascribed to the occurrence of a turbulent flow can be suppressed. Accordingly, it becomes possible to prevent the occurrence of turbulence of the warp yarn, forcibly blow the weft yarn end into the warp yarn opening and put the same in a stretched state, and form a firm and excellent tacked-in selvage.

What is claimed is:

1. A weft tack-in apparatus comprising:

a cutter for cutting weft yarn; and tack-in nozzles for folding back an end portion of the weft yarn cut by the cutter into a warp yarn opening using injection air currents, wherein said tack-in nozzles comprise injection ports respectively provided on upper and lower sides of a path which the weft yarn passes by a beating operation, wherein air guides projecting toward the warp yarn opening are formed at respective circumferential portions of the injection ports between the weft yarn path and the injection ports so as to cause respective injection air currents from said injection ports to cross the warp yarn opening.

2. The tack-in apparatus according to claim 1, wherein the air guides comprise injection port side surfaces and weft yarn path side surfaces, and the injection port side surfaces are inclined toward the weft yarn path at front end portions of the air guides.

3. The tack-in apparatus according to claim 1, wherein:

the injection ports are formed in a nozzle block provided adjacent to a warp yarn side of the cutter, the nozzle block is provided with a slit which is opened in three directions, the slit extends along the weft yarn path, the nozzle block is also provided with a weft yarn end releasing nozzle that is opened into the slit, the weft yarn end releasing nozzle is adapted to blow an end of the weft yarn in the slit toward a discharge side of the slit via injection air, the injection ports of the tack-in nozzles are opened at portions of a warp yarn side surface of the nozzle block which are respectively above and below the slit, and the air guides are provided at a portion of the nozzle block which is between the injection ports and the slit.

4. The tack-in apparatus according to claim 2, wherein:

the injection ports are formed in a nozzle block provided adjacent to a warp yarn side of the cutter, the nozzle block is provided with a slit which is opened in three directions, the slit extends along the weft yarn path, the nozzle block is also provided with a weft yarn end releasing nozzle that is opened into the slit, the weft yarn end releasing nozzle is adapted to blow an end of the weft yarn in the slit toward a discharge side of the slit via injection air, the injection ports of the tack-in nozzles are opened at portions of a warp yarn side surface of the nozzle block which are respectively above and below the slit, and the air guides are provided at a portion of the nozzle block which is between the injection ports and the slit.

5. The tack-in apparatus according to claim 1, wherein:

the nozzle block is provided with a slit which is opened in three directions, and the slit extends along the weft yarn path between the air guides.

* * * * *